United States Patent [19]

Aaron

[11] Patent Number: 4,538,516

[45] Date of Patent: Sep. 3, 1985

[54] TORQUE-ASSIST SYSTEM FOR PRINTING BELTS

[75] Inventor: Charles Aaron, West Caldwell, N.J.

[73] Assignee: Somerset Technologies, Inc., New Brunswick, N.J.

[21] Appl. No.: 292,390

[22] Filed: Aug. 13, 1981

Related U.S. Application Data

[63] Continuation of Ser. No. 30,694, Apr. 16, 1979, abandoned.

[51] Int. Cl.[3] ..... E16H 55/00; B41F 5/04

[52] U.S. Cl. ..... 101/219; 74/665 E; 101/248; 101/376; 101/DIG. 27; 198/834; 226/86; 318/7; 474/102; 474/149; 474/158; 474/164

[58] Field of Search ..... 226/188; 318/7; 474/102, 149, 160; 101/DIG. 27

[56] References Cited

U.S. PATENT DOCUMENTS

| | | | |
|---|---|---|---|
| 531,076 | 12/1894 | Waldron | 101/248 |
| 2,751,532 | 6/1956 | De La Bretoniere | 318/7 |
| 3,028,063 | 4/1962 | Busch | 226/117 |
| 3,058,638 | 10/1962 | Christoff | 226/76 |
| 3,116,000 | 12/1963 | Wales | 226/188 |
| 3,283,228 | 11/1966 | Asseo | 318/7 |
| 3,518,940 | 7/1970 | Stroud | 101/223 |
| 3,522,903 | 8/1970 | Lloyd | 226/188 |
| 3,644,806 | 2/1972 | Belson | 318/7 |
| 3,650,448 | 3/1972 | Jarmy | 226/86 |
| 3,666,156 | 5/1972 | Becker | 226/188 |
| 3,761,000 | 9/1973 | Hagstrom | 226/76 |
| 3,809,335 | 5/1974 | Mantey | 318/7 |
| 4,096,417 | 6/1978 | Chambolle | 318/7 |
| 4,366,371 | 12/1982 | de Costemore | 318/7 |

*Primary Examiner*—Clyde I. Coughenour

*Attorney, Agent, or Firm*—Fay, Sharpe, Fagan Minnich & McKee

[57] ABSTRACT

A printing belt extends around a rotatable cylinder having independently rotatable belt drive sprockets at the opposite ends thereof. A torque-assist drive connected with the cylinder is selectively operable for imparting supplemental traction to the belt for preventing relative slippage between the belt and drive sprockets.

17 Claims, 14 Drawing Figures

TORQUE-ASSIST SYSTEM FOR PRINTING BELTS

This is a continuation of application Ser. No. 030,694, filed Apr. 16, 1979, now abandoned.

BACKGROUND OF THE INVENTION

This application relates to the art of drive mechanisms and, more particularly, to drive mechanisms for driving a belt past a cylinder around which the belt extends. The invention is particularly applicable for use with belt-type of printing machines and will be particularly described with reference thereto. However, it will be appreciated that the invention has broader aspects and may be used for driving belts in general and is not limited to use for driving belts in belt-type of printing machines.

One example of a belt-type of printing machine is disclosed in U.S. Pat. No. 3,518,940 issued July 7, 1970, to Stroud et al. A continuous belt extends around rolls and is driven through a nip between plate and impression cylinders. The belt carries flexible printing plates which transfer images to a web of paper or the like passing through the nip around the impression cylinder. For halftones and multi-color printing, along with accurate slitting of the printed web, it is necessary to maintain accurate registration between the belt and the belt drive. One driving arrangement for maintaining accurate registration includes belt drive sprockets at opposite ends of the plate cylinder and having sprocket teeth engageable with longitudinally-spaced holes adjacent the longitudinal edges of the belt.

In the earliest drive arrangements of the type described, the sprockets were secured directly to the opposite ends of the plate cylinder and rotatably driven in unison therewith so the plate cylinder also transmitted drive traction to the belt. As a practical matter, it is not possible to machine the plate cylinder to such accurate dimensions that the plate cylinder would drive the belt at precisely the same speed as the drive sprockets. If the plate cylinder drives the belt slightly faster or slower than the drive sprockets, the belt and drive sprockets will slip relative to one another and registration will be lost, or the belt will break. In order to overcome this problem, as disclosed in the aforementioned Stroud patent, the belt drive sprockets are mounted for rotation independently of the plate cylinder. Torque is supplied from the drive sprockets to the plate cylinder through clutches. In addition, the outer surface of the plate cylinder is highly polished so it will slip easily relative to the belt. With this arrangement, it was believed that any tendency for relative movement between the belt and drive sprockets would be overcome by relatively easy slippage between the belt and plate cylinder. However, it has been found that such phenomenon as squeezing of the flexible printing plates between the nip produces a drag on the belt intermediate the drive sprockets and this drag cannot be overcome by relative slippage between the belt and plate cylinder, or between the plate cylinder and drive sprockets. Therefore, it has been found that registration is sometimes lost due to jumping of the sprockets relative to the belt.

It would be desirable to have an arrangement for preventing relative movement between the belt and belt drive sprockets in order to maintain accurate registration of the belt and printing plates carried thereby.

SUMMARY OF THE INVENTION

A belt-type of printing machine of the type described has a supplemental torque-assist drive for the plate cylinder which is selectively operated for supplying supplemental torque to the plate cylinder when there is impending relative movement between the belt and drive sprockets. This arrangement provides supplemental traction to the belt through the plate cylinder for preventing loss of registration.

In a preferred arrangement, the outer surface of the plate cylinder is provided with traction material having a high coefficient of friction for supplying driving traction to the belt.

In accordance with another aspect of the invention, sensing means is provided for sensing impending relative movement between the belt and the belt drive sprockets and then selectively operating the torque-assist drive for preventing such relative movement.

The torque-assist drive may take many forms, and the sensing means may also be of many different designs. In fact, it is possible to manually operate the torque-assist drive upon visual observation of impending slippage or visual observation of gauges or the like connected with the belt drive for showing impending slippage.

The torque-assist drive can be capable of imparting either positive or negative traction to the belt for positively driving or braking the belt depending upon the direction of impending relative movement between the belt and drive sprockets.

It is a principal object of the present invention to provide an improved belt drive mechanism.

It is an additional object of the invention to provide a belt-type printing machine with an improved belt drive mechanism which prevents loss of belt registration.

It is another object of the invention to provide an improved method of driving a belt and of maintaining registration of a belt in a belt-type of printing machine.

It is also an object of the invention to provide an improved belt drive mechanism which is relatively simple in operation.

DESCRIPTION OF PREFERRED EMBODIMENTS

Figure 1:
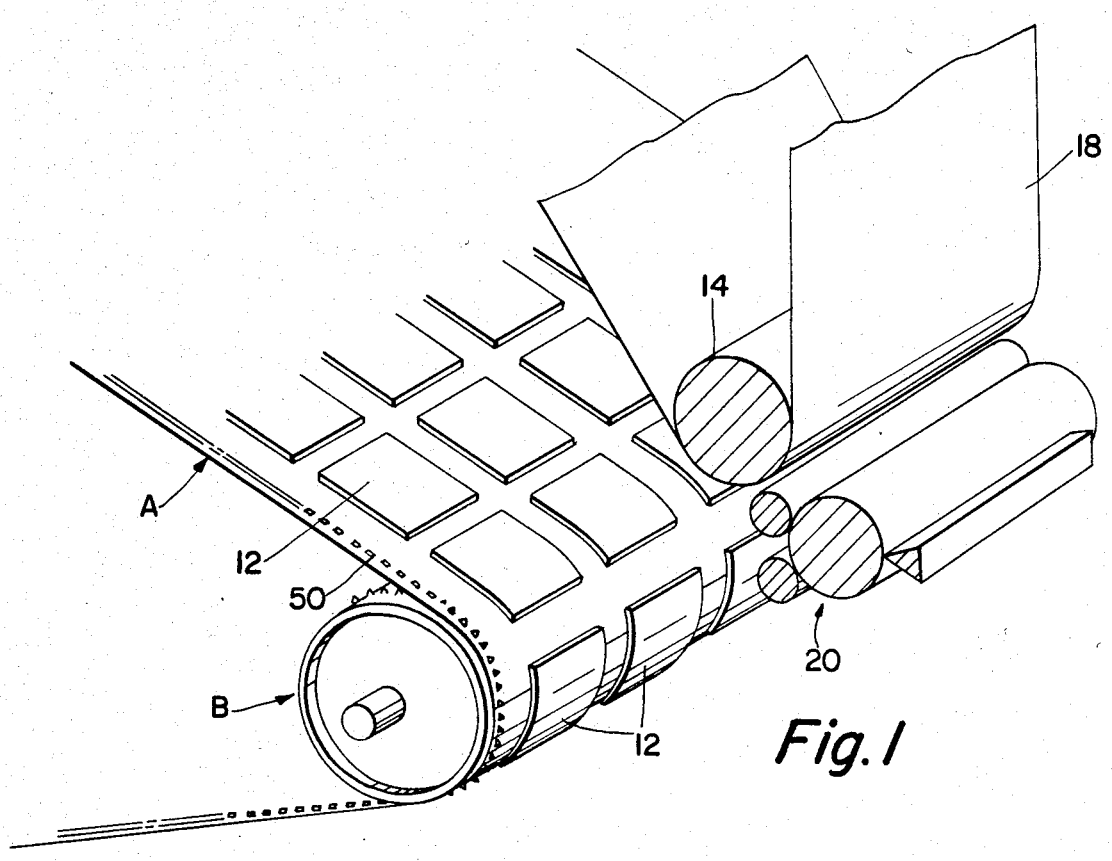
FIG. 1 is a schematic perspective illustration of a printing belt carrying flexible printing plates, and passing through a nip between plate and impression cylinders.

With reference to the drawing, FIG. 1 shows a continuous flexible belt of synthetic plastic material or the like having a plurality of flexible printing plates 12 mounted thereon. Printing belt A extends around a belt drive and plate cylinder assembly B which cooperates with an impression cylinder 14 to define a nip between which printing belt A and printing plates 12 pass for transferring images to a continuous web of paper or the like 18. An inking assembly is generally indicated at 20 for inking printing plates 12 which travel counterclockwise in FIG. 1 with printing belt A and the belt drive and plate cylinder assembly B.

Figure 2:
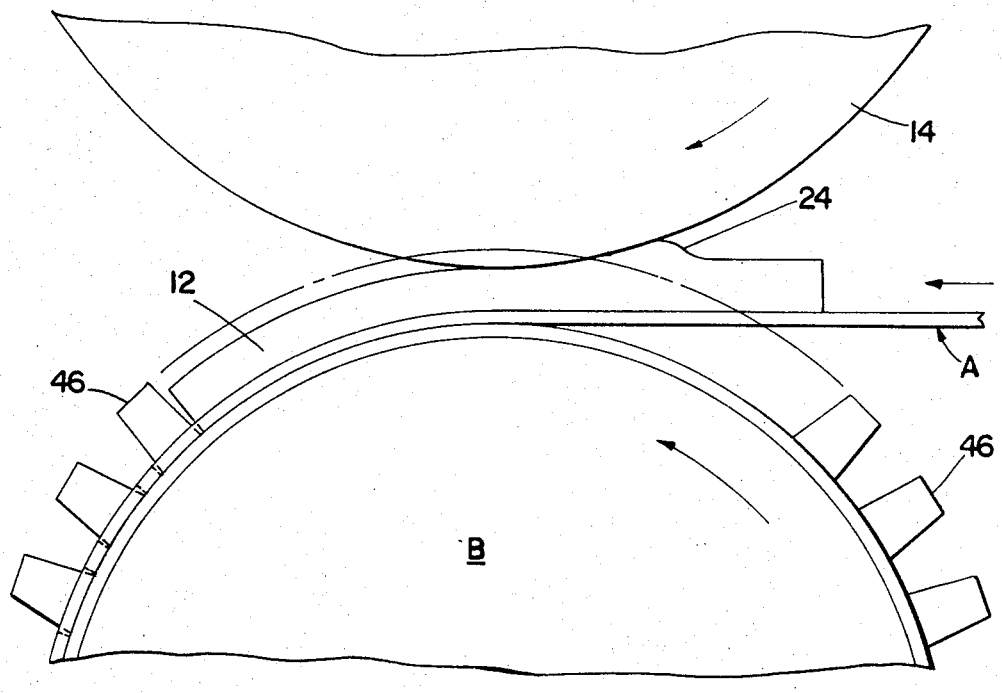
FIG. 2 is a partial cross-sectional elevational view showing a flexible printing plate carried by the belt passing through the nip between the plate and impression cylinders.

FIG. 2 shows printing belt A traveling from right to left through the nip between impression cylinder 14 and the belt drive and plate cylinder assembly B. Flexible printing plates 12 are squeezed as they pass through the nip and this causes a bulge in flexible printing plate 12 at the nip entrance, and such bulge is shown exaggerated at 24 in FIG. 2. This bulge creates a very high drag or resistance to movement of printing belt A through the nip and the high torque required to move the bulge through the nip can result in jumping of the drive sprockets ahead of the printing belt A. Due to the highly polished surface of the plate cylinder, sufficient drive traction cannot be imparted to the printing belt by the plate cylinder for overcoming the drag caused by the bulge. Placing traction material having a high coefficient of friction on the plate cylinder would provide sufficient supplemental traction but would again cause the problem of the plate cylinder driving the belt at a different speed than the drive sprockets.

Figure 3:
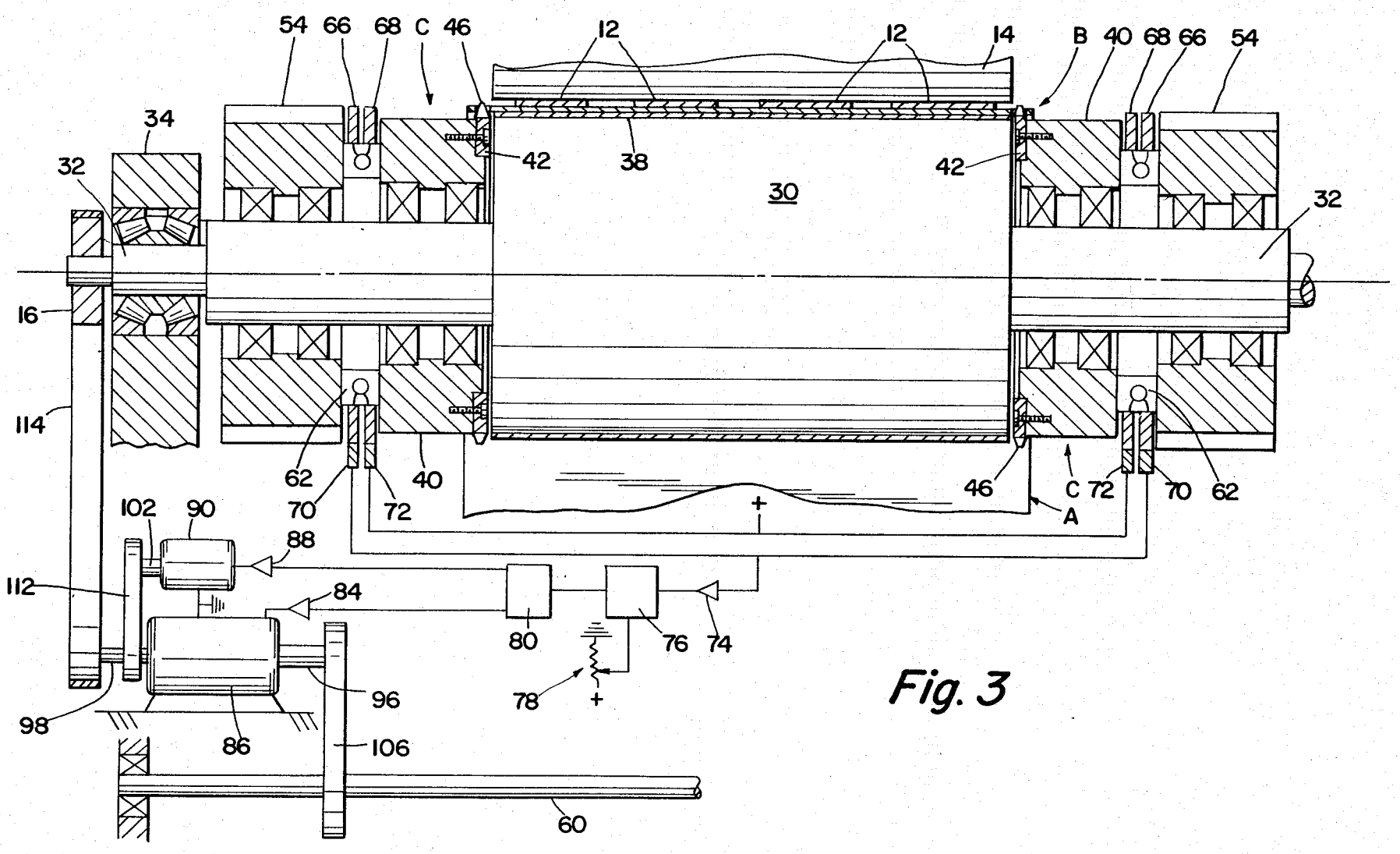
FIG. 3 is a cross-sectional elevational view showing one form of drive mechanism constructed in accordance with the present application.

In order to overcome the aforementioned problem and prevent relative movement between the belt and the positive belt drive, supplemental torque-assist means is provided for imparting supplemental torque to the plate cylinder. One arrangement for accomplishing this is shown in FIG. 3. Plate cylinder 30 has journals 32 rotatably supported in support bearing assemblies 34. The outer surface of plate cylinder 30 is coated or covered with traction material 38 having a high coefficient of friction. Traction material 38 may be a natural or synthetic rubber or other suitable traction material, and preferably covers the entire outer surface of plate cylinder 30 because discontinuities in traction material 38 can result in printing problems. Traction material 38 is capable of supplying high traction to printing belt A for driving same through the nip defined by impression cylinder 14 and plate cylinder 30. It will be recognized that other traction increasing arrangements could also be provided. For example, it is possible to provide a plurality of very small holes extending from the surface of plate cylinder 30 to an interior vacuum chamber suitably connected with a vacuum so that printing belt A would be held against plate cylinder 30 by the vacuum. The holes should be very small so the plate cylinder still provides nearly continuous backup support for the belt to prevent any printing problems due to discontinuities. In effect, the plate cylinder would be porous with the inner ends of the pores being connected to the interior of the plate cylinder which would be under a vacuum.

Belt drive means C are located at opposite ends of plate cylinder 30 and include hubs 40 rotatably mounted on journals 32, and sprockets 42 suitably secured to hubs 40. Sprockets 42 have circumferentially-spaced sprocket teeth 46 which extend through longitudinally-spaced holes shown at 50 in FIG. 1 adjacent the longitudinal side edges of printing belt A.

Drive gears 54 are rotatably mounted on journals 32 outwardly of drive hubs 40 and are suitably drivingly connected as by a train of gears with machine power shaft 60. Drive gears 54 are connected by electrical load cells 62 with drive hubs 40. Electrical load cells 62 are simply similar to electrical strain gauges and are characterized by having a variable resistance to flow of electricity therethrough depending upon the stress to which the load cell is subjected. Slip rings 66, 68 connected with load cells 62 are connected through electrical brushes 70, 72 with a control circuit and with a source of electricity.

Signals from load cells 62 are fed to a signal amplifier 74 connected to a comparator 76 having a reference signal impressed thereon by an adjustable reference signal device 78. The comparator 76 compares the reference signal with the load cell signal and sends any resultant signal to a differentiator 80 which determines whether the difference signal is positive or negative. Positive difference signals are fed through amplifier 84 to magnetic particle drive clutch 86, while negative difference signals are fed through amplifier 88 to magnetic particle brake 90.

Magnetic particle clutch 86 is of a known type and simply includes an outer rotating member on input shaft 96 which is radially spaced from an inner rotating member on output shaft 98. The radial space between the inner and outer rotating members is filled with magnetically attractive powder, and an electrical coil in the stator of the clutch surrounds the rotating members. Energization of the electrical coil produces a magnetic field which causes the powder to form a drive link between the inner and outer rotating members for transmitting torque. The amount of torque transmitted varies in accordance with the strength of the magnetic field which in turn varies in accordance with the current flow through the electrical coil. Magnetic particle brake 90 is similarly constructed and the rotating member on the output shaft 102 is simply radially spaced from a stationary member, and the radial space is filled with magnetically attractive powder. Energization of the coil in the magnetic particle brake 90 forms a link between the rotating member on the output shaft 102 and the stationary member for applying a variable braking torque. The braking torque varies in accordance with the strength of the magnetic field which in turn varies in accordance with the current supplied to the coil.

Input shaft 96 of magnetic particle clutch 86 is driven from machine drive shaft 60 as by a toothed belt 106 extending around suitable gears on drive shaft 60 and input shaft 96. Output shaft 98 of magnetic particle clutch 86 and output shaft 102 of magnetic particle brake 90 are connected by a toothed belt 112 extending around suitable gears on those shafts. A drive belt 114 extends around suitable gears on clutch output shaft 98 and a gear or pulley 116 fixed to the outer end of journal 32 on plate cylinder 30.

In operation of the apparatus, driving torque is supplied to drive gears 54 from machine drive shaft 60. Driving torque is transmitted from drive gears 54 through load cells 62 to drive hubs 40. This rotates sprockets 42 which positively drive printing belt A. The controls may be set so that magnetic particle clutch 86 is normally supplying sufficient torque to plate cylinder 30 to maintain rotation of same. In the event of a drag on printing belt A as previously described, additional driving torque will be required from drive gears 54 to drive hubs 40. This will cause additional deflection of load cells 62 so the load cell signal received by comparator 76 will exceed the reference signal from reference signal generating device 78. The positive signal is fed to differentiator 80 which in turn feeds it to magnetic particle clutch 86 for supplying supplemental torque to plate cylinder 30 which in turn supplies supplemental traction to printing belt A for positively driving same at a slightly greater speed than sprockets 42 for relieving the excessive load on the sprockets. As the load on the sprockets is relieved, the necessary torque from drive gears 54 to drive hubs 40 is reduced and this relaxes load cells 62 so the load cell signal again drops off for reducing the torque transmitted by magnetic particle clutch 86. If the printing machine is stopped rapidly, as under emergency conditions, the momentum of the belt and plate cylinder could cause printing belt A to be driven past sprockets 42 so that registration would be lost. However, a condition of that type will result in hubs 40 tending to drive back through load cells 62 to drive gears 54 so that load cells 62 are completely relieved of stress or stressed in an opposite direction. The load cell signal from comparator 76 is then sent by differentiator 80 to magnetic particle brake 90 for applying a braking force to plate cylinder 30 for preventing printing belt A from slipping past sprockets 42.

Instead of having fully automatic operation of a drive system in the manner described, it will be recognized that it is also possible to simply have visible gauges or the like in place of load cells 62 and to manually operate controllers for controlling the torque transmitted by magnetic particle clutch 86 and magnetic particle brake 90. The sensing means defined by the load cells 62 senses impending relative movement or slippage between printing belt A and drive means C. The sensing means also senses relative rotational movement between drive gears 54 and drive hubs 40. Indirectly, the sensing means also senses a change in the speed of the belt at its longitudinal edges as compared to the central portion of the printing belt between the drive sprockets. The sensing means automatically operates to operate the plate cylinder drive means or torque-assist means defined by magnetic particle clutch 86 and magnetic particle brake 90. Supplemental torque is then selectively supplied to plate cylinder 30 for supplying supplemental traction to printing belt A to prevent the impending relative movement between the belt and belt drive means. The traction supplied to the printing belt by plate cylinder 30 can be either positive drive traction or braking traction.

Figure 4:
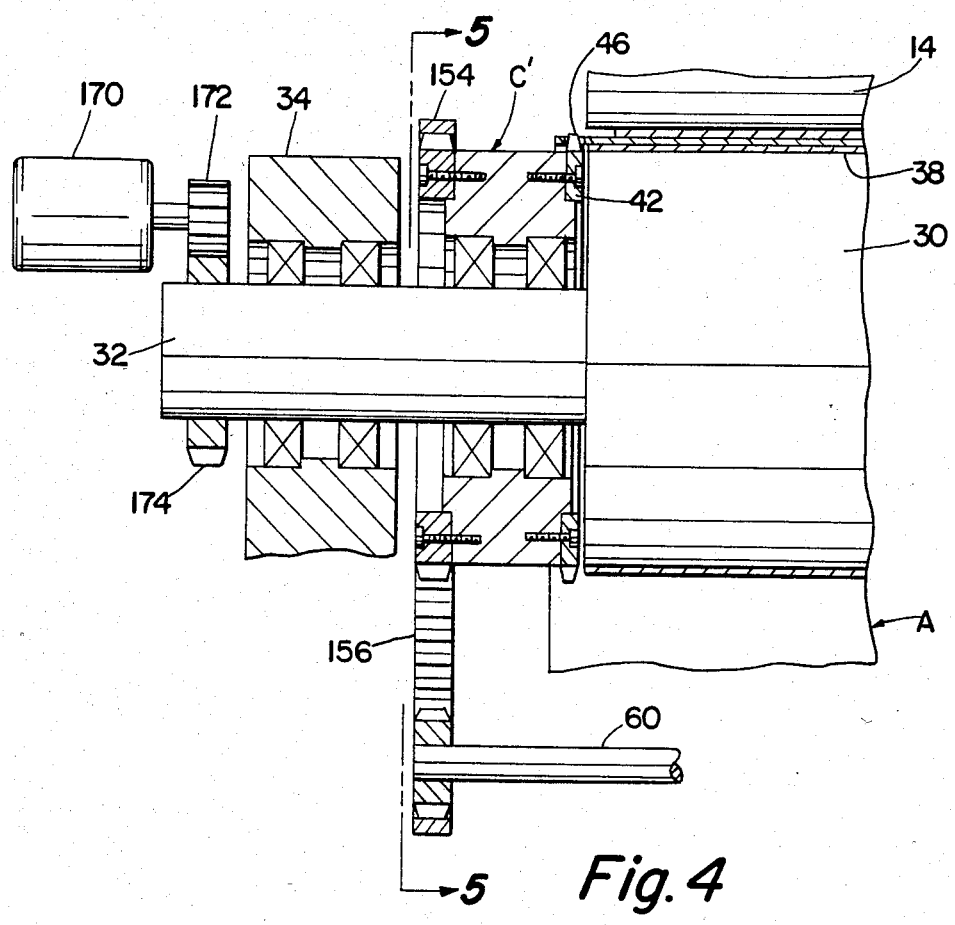
FIG. 4 is a partial cross-sectional elevational view showing another drive mechanism.
Figure 5:
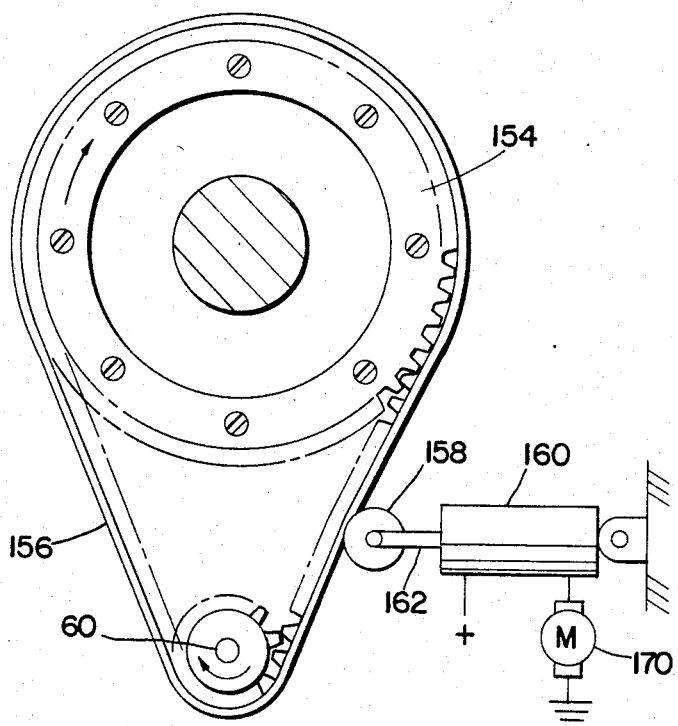
FIG. 5 is a cross-sectional elevational view taken generally on line 5—5 of FIG. 4.

FIGS. 4 and 5 show another arrangement wherein belt drive means C′ includes a combined hub and drive gear 154 rotatably mounted on journal 32 and drivingly connected with machine drive shaft 60 by a toothed drive belt 156. As shown in FIG. 5, a roller 158 is biased against the tension side of drive belt 156 for normally deflecting same. Roller 158 is biased by a cylinder 160 which also has an internal resistance which varies in accordance with the projecting length of cylinder shaft 162 carrying roller 158. Control signals passing through cylinder 160 are fed to an electric motor 170 drivingly connected by gear 172 with a drive gear 174 fixed on plate cylinder journal 32 for supplying torque-assist to plate cylinder 30. As the resistance to movement of the printing belt increases, additional torque is required on sprockets 42 and this increases the tension in that portion of drive belt 156 engaging roller 158 so that roller 158 deflects to the right in FIG. 5 for increasing the signal sent to motor 170 which then increases its driving torque to plate cylinder 30 for relieving the drag on the printing belt. When the tension in that portion of belt 156 engaging roller 158 is relieved, roller 158 again extends outwardly and the signal provided to electric motor 170 is reduced so the driving torque to plate cylinder 30 is reduced. Although motor 170 itself provides a braking drag when energized at very low levels, it will be recognized that it is also possible to provide an additional motor or generator to function as a brake for supplying braking traction to plate cylinder 30.

It will be recognized that many other automatic sensing devices may be used for sensing impending relative movement between the belt and belt drive means for automatically operating a torque-assist means for supplying supplemental torque to the plate cylinder which in turn supplies supplemental traction to the printing belt for preventing the relative slippage.

Figure 6:
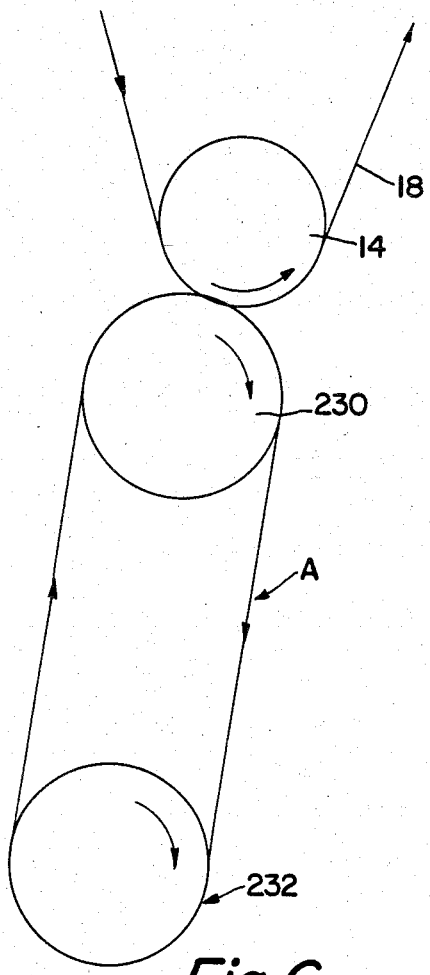
FIG. 6 is a schematic illustration of another drive arrangement.

Instead of having the belt drive and plate cylinder cooperating with an impression cylinder to define the nip through which the printing belt moves, it will be recognized that many other arrangements are possible, and only a few of such alternative arrangements will be described. FIG. 6 shows a rotatable impression cylinder 14 cooperating with a rotatable idling plate cylinder 230 having printing belt A extending therearound, and driven by a drum and sprocket system 232 corresponding to the sprocket and plate cylinder driving arrangements described with respect to FIGS. 1–5. An arrangement of this type is not as good as the preferred arrangement because the elasticity of printing belt A makes registration difficult and the printing belt joint is subjected to extreme tension.

Figure 7:
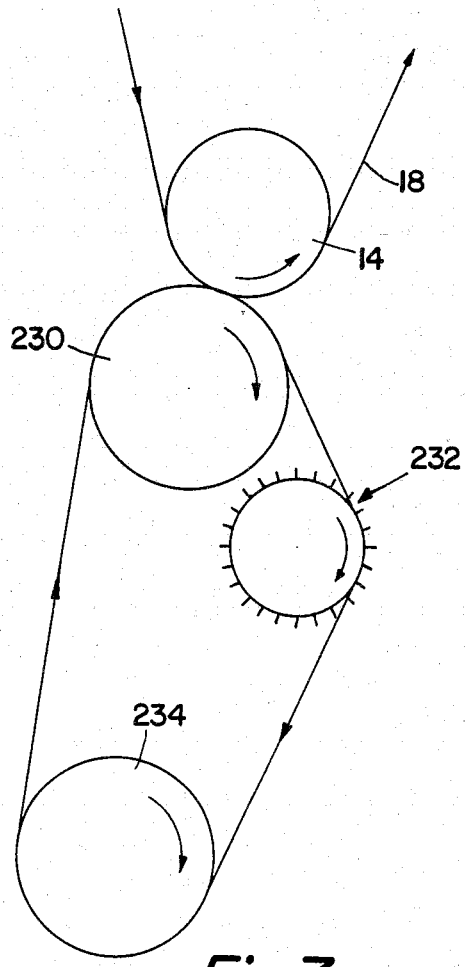
FIG. 7 is a schematic illustration of still another drive arrangement.

FIG. 7 shows an arrangement wherein a sprocket and drum drive 232 located much closer to idling plate cylinder 230. An additional idler roll 234 completes the system. This reduces errors in registration and increases the minimum belt length that can be accommodated. However, a severe load would still be placed on the belt joint.

Figure 8:
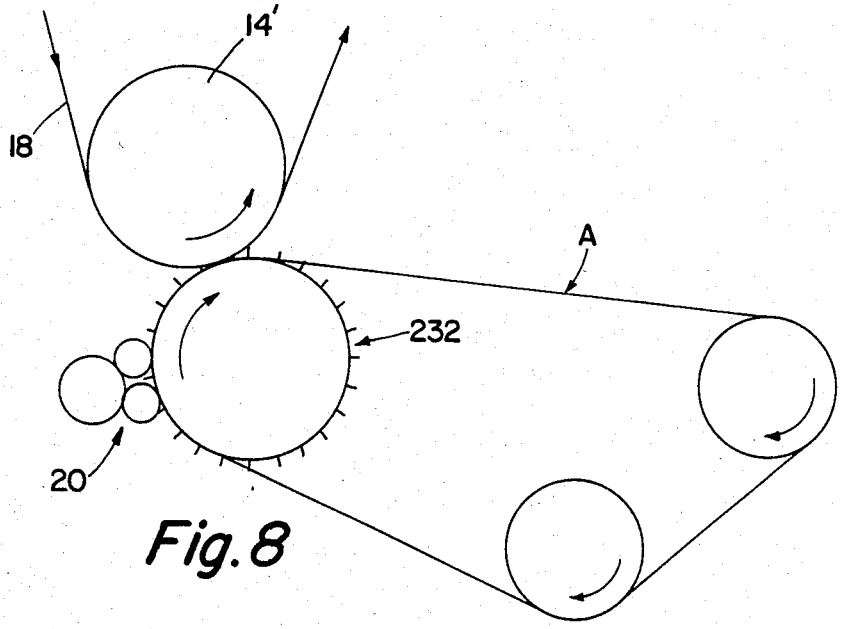
FIG. 8 is a schematic illustration of still another drive arrangement.

FIG. 8 shows a direct lithography system in which belt A contains lithographic images of a planographic nature which are transferred to web 18 extending around a rubber covered impression drum 14′. Even if the lithographic image on belt A is formed by rigid plates of metal or plastic, the rubber covered drum 14′ produces the same bulging effect requiring the supplemental drive to the central drum located between the opposite drive sprockets in drive assembly 232.

In all of the arrangements described, the belt drive system includes belt drive means located at opposite ends of a cylinder around which the belt extends. The belt drive means is rotatable independently of the cylinder and sensing means is provided for sensing impending relative movement between the belt and belt drive means. The sensing means is used for operating torque-assist means which supplies supplemental torque to the cylinder for imparting supplemental traction to the belt and preventing the impending slippage between the belt and belt drive means. The supplemental traction supplied from the cylinder to the belt may be either driving traction or braking traction.

Figure 9:
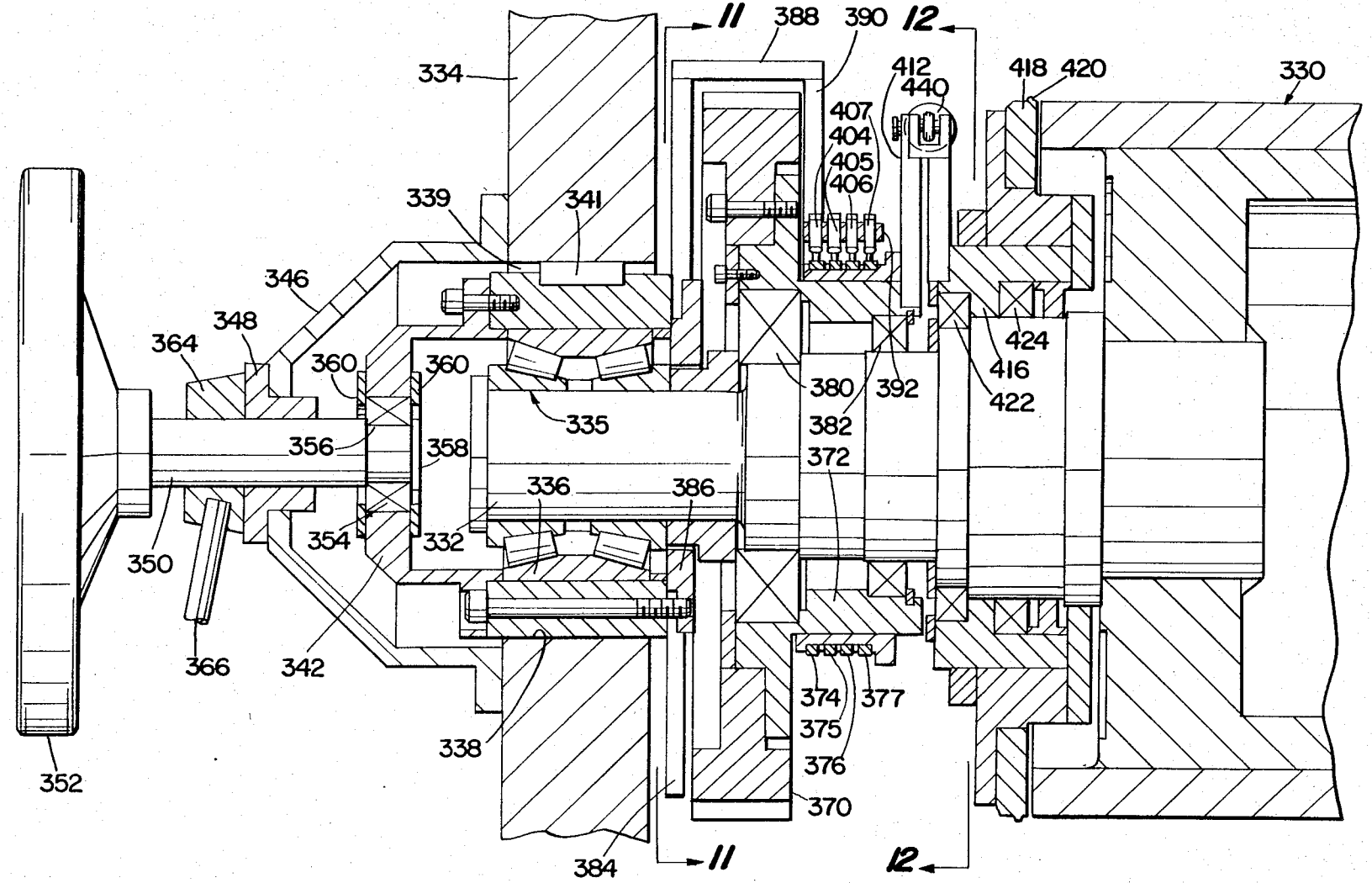
FIG. 9 is a partial cross-sectional elevational view showing a drive arrangement at one end of a plate cylinder.
Figure 10:
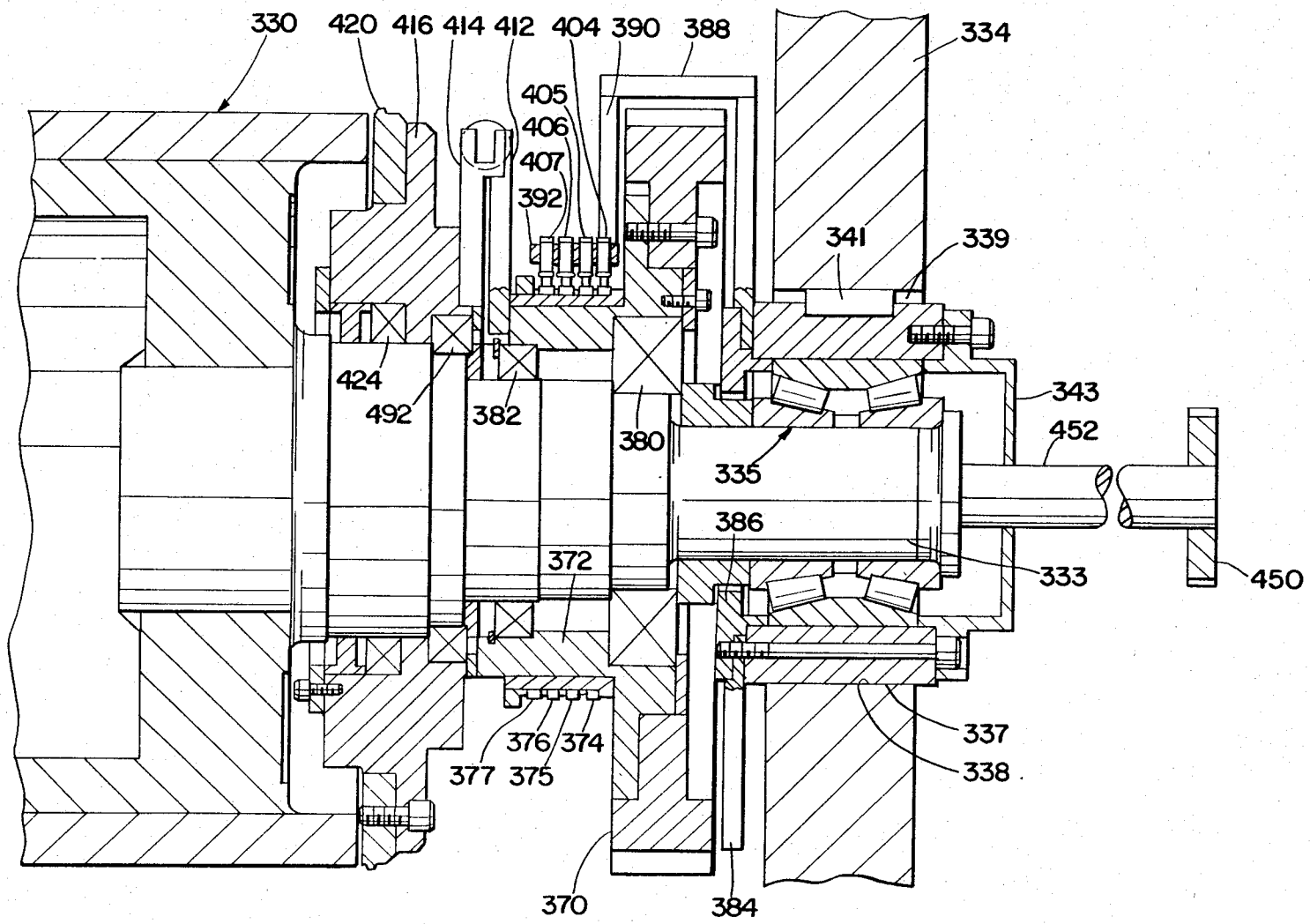
FIG. 10 is a partial cross-sectional elevational view similar to FIG. 9 and showing the drive arrangement at the other end of a plate cylinder.
Figure 11:
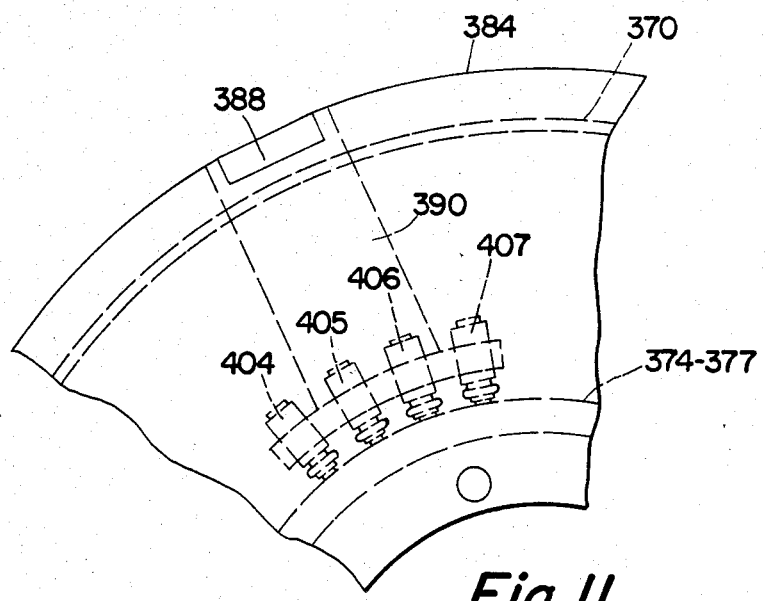
FIG. 11 is a partial cross-sectional elevational view taken generally on line 11—11 of FIG. 9.

FIGS. 9–14 show another plate cylinder drive arrangement and a control system therefor. With reference to FIGS. 9 and 10, plate cylinder 330 has its outer cylinder surface coated or covered with a material having a high coefficient of friction as described with reference to plate cylinder 30 of FIGS. 3 and 4. Plate cylinder 330 has opposite end journals 332 and 333 rotatably mounted in supports 334 by bearing assemblies 335. Bearing holders 336, 337 are received in suitable openings 338 in supports 334 for supporting bearings 335. Longitudinal grooves 339 extending radially of openings 338 receive keys 341 on bearing holders 336, 337 for preventing rotation of such holders relative to supports 334, while allowing longitudinal movement of holders 336, 337 relative to supports 334. Outer bearing retainers 342, 343 are secured to bearing holders 336, 337.

A cup member 346 suitably secured to support 334 over outer bearing retainer 342 has an opening therein aligned with the longitudinal axis of plate cylinder 330 and a threaded nut 348 received in such hole is also suitably secured to cup 346 against rotational or longitudinal movement relative thereto. A threaded shaft 350 on a hand wheel 352 extends threadably through nut 348. A bearing 354 is positioned between shaft 350 and periphery of a hole in outer bearing retainer 342. Relative axial movement between shaft 350 and bearing 354 is prevented by a shoulder 356 on shaft 350 and an outer retainer 358 secured on shaft 350. Relative axial movement between bearing 354 and outer retainer 342 is prevented by opposite retainers 360 suitably secured to retainer 342. Thus, shaft 350 can rotate relative to retainer 342 but cannot move axially relative thereto. A lock nut 364 threaded on shaft 350 has one or more handles 366 attached thereto. Movement of lock nut 364 securely against nut 348 prevents rotation of shaft 350. Loosening of lock nut 364 allows rotation of shaft 350 by operation of hand wheel 352 for shifting bearing retainer 342 axially. This also shifts bearings 335 axially and results in limited axial movement of plate cylinder 330 for properly aligning the belt and the printing plates carried thereby. For multi-color printing, it is necessary to obtain very accurate alignment of the printing plates at the various printing stations. The limited axial movement of the plate cylinder allows a fine adjustment of the printing plates to insure alignment at the various printing stations.

Drive gears 370 are suitably drivingly connected with the main drive shaft of the press. Drive gears 370 are bolted to electrical ring holders 372 on which four electrical rings 374–377 are mounted in spaced-apart relationship. Electrical ring holders 372 are rotatably mounted on journals 332, 333 by bearings 380 and 382.

Plate discs 384 are suitably bolted to bearing holders 336, 337 as by the same bolts which secure inner bearing retainers 386 to holders 336, 337. Thus, plate discs 384 are fixed against rotation. Plate extensions 388 extend from plates 384 substantially parallel to the longitudinal axis of plate cylinder 330 in outwardly-spaced relationship to drive gears 370. Extensions 388 completely span drive gears 370 and have inwardly extending members 390 connected with the outer ends thereof, and extending inwardly on the opposite side of drive gears 370 from plates 384. Brush supports 392 are attached to the free ends of members 390 and extend away from drive gears 370 substantially parallel to the longitudinal axis of plate cylinder 330 for supporting four electrical brushes 404–407 which cooperate with electrical rings 374–377.

Transducer mounting plates 412 are suitably bolted to ring holders 372 in opposed relationship to transducer mounting plates 414 which are suitably bolted to holders 416 for belt drive sprockets 418 having sprocket teeth 420 thereon for engaging the holes in the longitudinal edges of the printing belt on which the printing plates are mounted. Belt drive sprocket holders 416 are rotatably mounted on journals 332, 333 as by bearings 422, 424.

Figure 12:
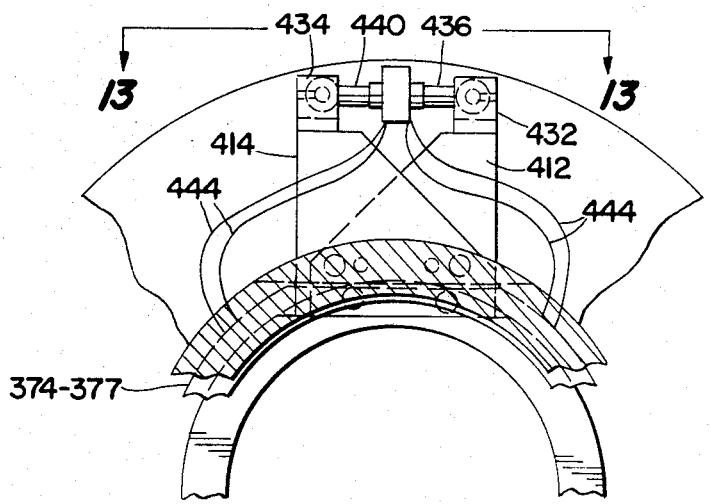
FIG. 12 is a partial cross-sectional elevational view taken generally on line 12—12 of FIG. 9.
Figure 13:
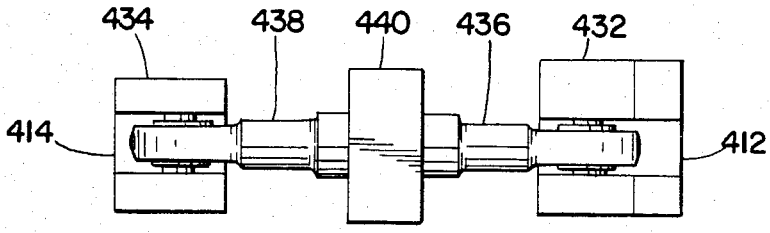
FIG. 13 is a top plan view taken generally on line 13—13 of FIG. 12.

With reference to FIGS. 12 and 13, the upper edges of each plate 412, 414 have a clevis 432, 434 therein for making pinned connections with rods 436, 438 attached to a transducer 440 whose electrical resistance varies in accordance with the tension to which it is subjected. Wires indicated generally by numeral 444 in FIG. 12 connect transducer 440 with brushes 404–407 to control the excitation of an electric motor drivingly connected with a gear 450 in FIG. 10 on a stub shaft 452 attached with journal 333 on plate cylinder 330. The electric motor directly drives plate cylinder 330 through gear 450 and shaft 452. Driving torque for belt drive sprockets 418 is transmitted through transducers 440 and their mounting plates 412–414 from drive gears 370.

Four brushes 404–407 and cooperating rings 374–377 are used simply to insure continuous conductivity. One pair of brushes and rings is used for transducer input and the other pair for transducer output. Thus, operation of the apparatus is not affected by momentary interruptions in conductivity between one brush and ring of each pair due to such things as ring irregularity or brush bounce.

Figure 14:
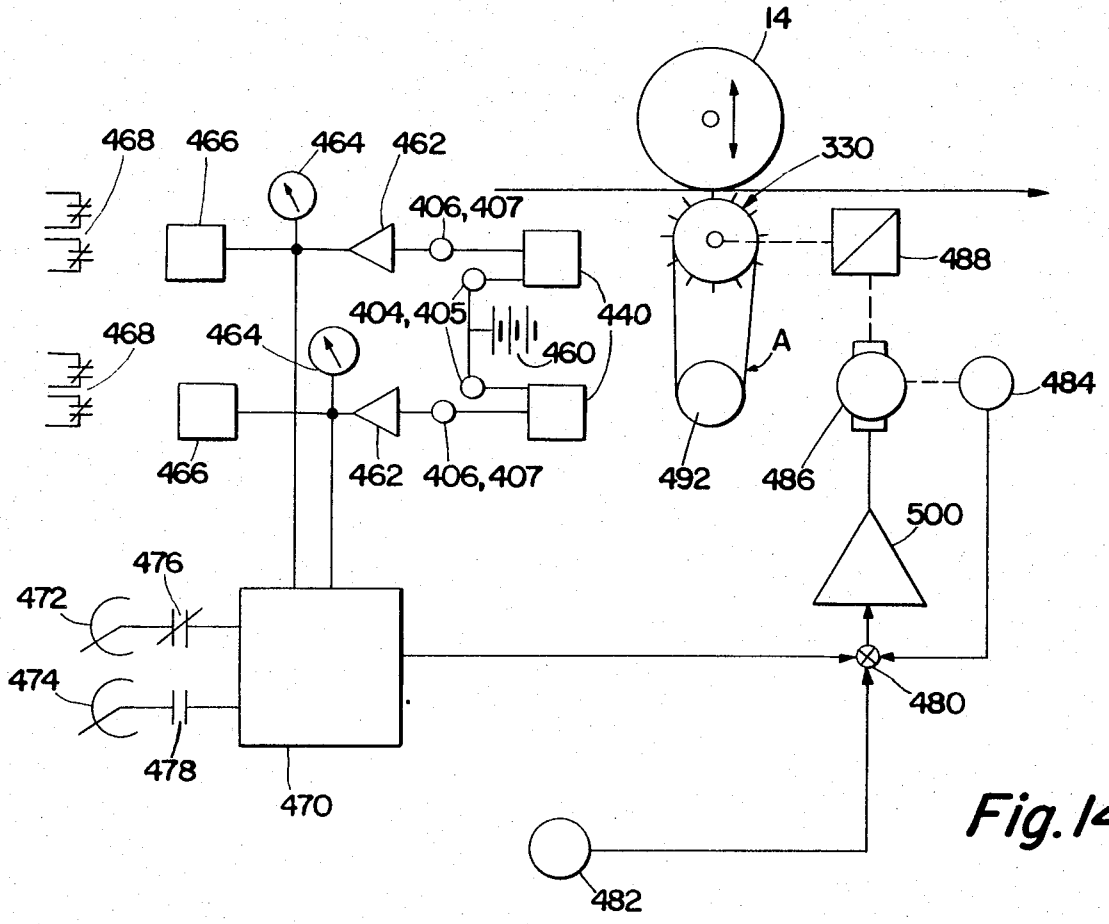
FIG. 14 is a schematic of a control arrangement for the drive system of FIGS. 9-13.

A voltage source generally indicated at 460 in FIG. 14 applies a voltage to transducers 440 through brushes 404, 405 and their associated rings 374, 375. The current through transducers 440 varies in accordance with the stress on the transducers, and the output passes through brushes 406, 407 and their associated rings 376, 377 to amplifiers 462. The sprockets 42 or 418 are individually mechanically adjustable to be sure that equal driving force is applied to both of the opposite edge portions of the printing belt. For purposes of this mechanical sprocket adjustment, the signals from amplifiers are supplied to torque meters 464 which indicate the pounds of stress on the individual transducers, and visually inform the operator that sprocket adjustment is necessary. Sprocket adjustment is carried out until the driving force applied at both edge portions of the printing belt is equalized as indicated by equal readings on the torque meters 464.

The signals from amplifiers 462 also pass to voltage sensitive relays 466 which operate, when the transducers are subjected to excessive stress, for shutting down the main drive for the entire apparatus by opening normaly closed contacts 468 which are suitably connected between the power supply and the main drive motor.

The signals from amplifiers 462 are also fed to a summing and trimming device 470 which sums the two signals from the amplifiers 462 and compares the sum with a reference signal provided by either an adjustable low torque input set pot 472 or an adjustable high torque set port 474.

Impression cylinder 14 is movable toward and away from plate cylinder B or 330. When starting up the press, impression cylinder 14 is in a position moved away from the plate cylinder. A limit switch operated by the position of impression cylinder 14 has a contact 476 between low set pot 472 and device 470 which is normally closed when impression cylinder 14 is in its position away from plate cylinder 330. The limit switch has contacts 478 between high set pot 474 and device 470 which are open when impression cylinder 14 is in its position away from plate cylinder 330, and are closed when impression cylinder 14 is moved to its cooperative position adjacent plate cylinder 330. When the apparatus is started up, the low torque set pot provides the signal to device 470. Impression cylinder 14 moves toward plate cylinder 330 and eventually reaches its operating position. At that time, the limit switch operates for opening contacts 476 and closing contacts 478 so that during operation of the apparatus the reference signal is provided to device 470 by high set pot 474. The desirable input signal from high torque set pot 474 is compared by device 470 with the sum of the signals actually received from transducers 440. The resulting difference signal, if any, is fed to a comparator device 480 which also receives signals from a tachometer 482 connected with the main drive for belt A and a tachometer 484 connected with electric motor 486 which is drivingly connected to gear 450 of FIG. 10 for directly driving the shaft of plate cylinder 330. Electric motor 486 is connected with the gear 450 of FIG. 10 through a gear box 488 shown in FIG. 14. An idler roll 492 is indicated in FIG. 14 for printing belt A simply for convenience of illustration.

The signals fed to comparator device 480 are compared and any difference signal is then fed to a motor control device 500 which provides signals to adjust the armature voltage of motor 486 for operating same to maintain the speed of plate cylinder 330 approximately the same as the speed of belt A. If excessive torque is being exerted on belt A by sprockets 418, the higher stress on transducers 440 will result in more driving torque being provided to motor 486 for providing more driving torque directly to plate cylinder 330. If the signal provided by transducers 440 is less than that set in high torque set pot 474, this means that the sprockets are trying to unload. That is, the driving force provided by the sprockets is diminishing below the level required for proper operation of the apparatus. This may result from a number of different reasons, including the possibility that the driving force being imparted directly to the belt by plate cylinder 330 is too high. Therefore, motor 486 will act as a generator and provide a braking force on plate cylinder 330 to prevent plate cylinder 330 from driving belt A past sprockets 418. Trimming device 470 provides greater sensitivity and more accurate control of the motor 486 than would be possible using only signals from tachometers 482 and 484.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A belt drive system, such as used in printing machines, comprising:

a belt, a cylinder for tractively engaging said belt, cylinder drive means for driving said cylinder, belt drive means at the opposite ends of said cylinder for positively driving said belt, means independent from said cylinder drive means for driving said belt drive means such that a drag condition may be imparted to said belt which tends to cause said belt to skip relative to said cylinder and belt drive means, sensing means disposed in contact with said belt drive means for detecting changes in loading which would tend to cause said belt to skip, and means for selectively operating said cylinder drive means to vary the torque applied to said cylinder by said cylinder drive means in response to said changes sensed to thereby alleviate such tendency to skip.

2. The printing machine of claim 1 wherein said plate cylinder is covered with a material having a high coefficient of friction.

3. The printing machine of claim 1 wherein said sensing means senses relative rotation between said plate cylinder and said belt drive means.

4. The printing machine of claim 1 including brake means for braking rotation of said plate cylinder when said belt tends to overrun said belt drive means.

5. The printing machine of claim 1 wherein said belt drive means comprises sprocket wheels having sprocket pins engaging longitudinally-spaced holes adjacent the longitudinal edges of said belt.

6. A belt drive, comprising:

a rotatable cylinder for tractively engaging a belt, belt drive means at opposite ends of said cylinder for positively driving the longitudinal edge portions of the belt, cylinder drive means for selectively driving said cylinder so that a belt extending around said cylinder and belt drive means is driven at approximately the same speed past said cylinder as past said belt drive means, means independent from said cylinder drive means for driving said belt drive means whereby a drag condition may be imparted to said belt which tends to cause said belt to skip relative to said cylinder and belt drive means, sensing means disposed in contact with said belt drive means for detecting changes in loading that would tend to cause said belt to skip, and means responsive to said sensing means for selectively operating said cylinder drive means to vary the torque applied to said cylinder by said cylinder drive means in resonse to said changes sensed to thereby alleviate such tendency to skip and maintain the speed of the belt past said cylinder approximately the same as the belt speed past said belt drive means.

7. The belt drive of claim 6 including material having a high coefficient of friction on the outer surface of said cylinder.

8. A belt drive system, comprising:

a rotatable cylinder for tractively engaging, supporting and guiding a movable belt, belt drive means at opposite ends of said cylinder for positively driving the belt past said cylinder, said belt drive means being rotatable independently of said cylinder, torque assist means for selectively driving said cylinder, and means independent from said torque assist means for driving said belt drive means whereby a drag condition may be imparted to the belt which tends to cause the belt to skip relative to said cylinder and belt drive means, sensing means disposed in contact with said belt drive means for detecting changes in loading that would tend to cause the belt to skip, means responsive to said sensing means for selectively operating said torque assist means to vary the torque applied to said cylinder by said torque assist means in response to said changes sensed by said sensing means to thereby alleviate such tendency to skip.

9. The belt drive system of claim 8 wherein said sensing means is disposed between said belt drive means and said means for driving said belt drive means to transmit torque to said belt, and senses the torque being applied by said belt drive means.

10. The belt drive system of claim 8 including traction material having a high coefficient of friction on the outer surface of said cylinder.

11. The belt drive system of claim 8 wherein said torque assist means is operative to provide either driving or braking torque to said cylinder.

12. A method of driving a belt past a rotatable cylinder that tractively engages the belt and having independently rotatable belt drive means for driving the belt at opposite ends thereof, said cylinder being driven by cylinder drive means, comprising the steps of:

engaging the longitudinal edges of the belt with said independently rotatable drive means, means independently of the cylinder drive means to drive said belt past said cylinder whereby a drag condition may be imparted to the belt which tends to cause the belt to skip relative to the cylinder and belt drive means, sensing through contact with said belt drive means changes in loading that would tend to cause said belt to skip, and responding to changes sensed by selectively operating said cylinder drive means to vary the torque applied to said cylinder by said cylinder drive means for applying supplemental traction to said belt for alleviating such tendency to skip and thereby preventing relative movement between said belt and belt drive means.

13. A method of preventing relative movement between a printing belt and belt drive means which drive the belt through a nip between plate and impression cylinders, said plate cylinder being able to tractively engage the belt, comprising the steps of:

positively driving longitudinal edges of the belt at the opposite ends of said plate cylinder with said belt drive means, driving said belt drive means independently of said plate cylinder whereby a drag condition may be imparted to said belt which tends to skip relative to said plate cylinder and belt drive means, sensing by means disposed in contact with said belt drive means, changes in loading that would tend to cause said belt to skip, and responding to changes sensed by selectively operating plate cylinder drive means to vary the torque applied to said plate cylinder by said plate cylinder drive means and thereby supplying supplemental torque to said plate cylinder as required for applying supplemental traction to said belt to alleviate such tendency to skip and prevent relative movement between said belt and belt drive means.

14. A belt-type of printing machine, comprising:

an impression cylinder and a plate cylinder between which a belt travels, a continuous belt extending between said cylinders and being tractively engaged by said plate cylinder, flexible printing plates carried by said belt on the surface thereof facing said impression cylinder, belt drive means at the opposite ends of said plate cylinder for positively driving said belt means independent from said cylinder drive means to drive said belt drive means whereby said plates tend to be squeezed between said cylinders such that a drag condition is imparted to said belt which tends to cause said belt drive means to skip relative to said belt, plate cylinder drive means for selectively driving said plate cylinder independently of said belt drive means for selectively imparting traction to said belt through said plate cylinder to overcome any drag on said belt and thereby prevent skipping of said belt drive means relative to said belt, sensing means disposed in contact with said belt drive means for sensing changes in loading that would tend to cause said belt to skip, and means responsive to said sensing means for selectively operating said plate cylinder drive means to vary the torque applied to said plate cylinder by said plate cylinder drive means in response to said condition sensed to thereby alleviate such tendency to skip.

15. A belt drive, comprising:

a rotatable cylinder for tractively engaging a belt, belt drive means at the opposite ends of said cylinder for driving the longitudinal edge portions of a belt extending around said cylinder and said belt drive means, variable speed cylinder drive means for selectively driving said cylinder so that a belt extending around said cylinder and belt drive means is driven at approximately the said speed past said cylinder as past said belt drive means, means independent from said cylinder drive means to drive said belt drive means whereby a drag condition may be imparted to said belt which tends to cause said belt to skip relative to said cylinder and belt drive means, sensing means disposed in contact with said belt drive means for sensing changes in loading that would tend to cause said belt to skip, and means responsive to said sensing means for selectively operating said cylinder drive means to vary the torque applied to said plate cylinder by said plate cylinder drive means in response to said condition sensed to alleviate such tendency to skip.

16. A belt drive system, comprising:

a rotatable cylinder for tractively engaging, supporting and guiding a movable belt, belt drive means at the opposite ends of said cylinder for positively driving a belt past said cylinder, said belt drive means being rotatable independently of said cylinder, selectively operable torque assist means for selectively driving said cylinder to prevent relative movement between said belt drive means and the belt, means, independent from said torque assist means for driving said belt drive means whereby a drag condition may be imparted to said belt which tends to cause said belt to skip relative to said cylinder and belt drive means, sensing means disposed in contact with said belt drive means for sensing changes in loading that would tend to cause said belt drive means to skip, and means responsive to said sensing means for operating said torque assist means to vary the torque applied to said plate cylinder by said torque assist means in response to said condition sensed to alleviate such tendency to skip.

17. A method of driving a belt past a rotatable cylinder with independently rotatable belt drive means, comprising the steps of:

tractively engaging said belt with said cylinder, positively driving edges of the belt at opposite ends of said cylinder with said belt drive means, driving said belt drive means independently of said cylinder whereby a drag condition may be imparted to said belt which tends to skip relative to said cylinder, sensing by means disposed in contact with said belt drive means, changes in loading that would tend to cause said belt to skip, and responding to changes sensed by selectively varying torque supplied to said cylinder in response to said changes sensed for applying supplemental traction to said belt for alleviating such tendency to skip and thereby preventing relative movement between said belt and belt drive means.

* * * * *